US011300339B2

(12) United States Patent
Cluff et al.

(10) Patent No.: US 11,300,339 B2
(45) Date of Patent: Apr. 12, 2022

(54) METHOD FOR OPTIMIZING PRESSURE EQUALIZATION IN REFRIGERATION EQUIPMENT

(71) Applicant: Carrier Corporation, Palm Beach Gardens, FL (US)

(72) Inventors: Charles A. Cluff, Zionsville, IN (US); Matthew T. Austin, Brownsburg, IN (US)

(73) Assignee: Carrier Corporation, Palm Beach Gardens, FL (US)

( * ) Notice: Subject to any disclaimer, the term of this patent is extended or adjusted under 35 U.S.C. 154(b) by 359 days.

(21) Appl. No.: 16/284,196

(22) Filed: Feb. 25, 2019

(65) Prior Publication Data

US 2019/0310005 A1 Oct. 10, 2019

Related U.S. Application Data

(60) Provisional application No. 62/653,044, filed on Apr. 5, 2018.

(51) Int. Cl.

| | |
|---|---|
| ***F25B 49/02*** | (2006.01) |
| ***F25B 13/00*** | (2006.01) |
| ***F25B 31/02*** | (2006.01) |

(52) U.S. Cl.

CPC ..... *F25B 49/022* (2013.01); *F25B 13/00* (2013.01); *F25B 31/026* (2013.01); *F25B 2500/26* (2013.01); *F25B 2500/27* (2013.01); *F25B 2600/01* (2013.01); *F25B 2600/02* (2013.01); *F25B 2600/0271* (2013.01); *F25B 2600/0272* (2013.01); *F25B 2600/15* (2013.01); *F25B 2700/193* (2013.01);

(Continued)

(58) Field of Classification Search

CPC ..... F25B 13/00; F25B 49/022; F25B 31/026; F25B 2400/0401; F25B 2600/02; F25B 2700/193; F25B 2700/1931; F25B 2700/1933; F25B 2700/2115; F25B 2700/2106; F25B 2600/01; F25B 2600/23; F25B 2600/0271; F25B 2600/0272; F25B 2600/15

See application file for complete search history.

(56) References Cited

U.S. PATENT DOCUMENTS

| | | | |
|---|---|---|---|
| 3,398,551 | A | 8/1968 | Yannascoli |
| 3,435,628 | A | 4/1969 | Russell |
| 3,632,231 | A | 1/1972 | Bloom |

(Continued)

FOREIGN PATENT DOCUMENTS

| | | | |
|---|---|---|---|
| CN | 106403373 | A | 2/2017 |
| CN | 10662261 | A | 5/2017 |

(Continued)

*Primary Examiner* — Jerry-Daryl Fletcher
*Assistant Examiner* — Daniel C Comings
(74) *Attorney, Agent, or Firm* — Bachman & LaPointe, P.C.

(57) ABSTRACT

In a method for operating a compressor (22) having an inlet (26) and an outlet (28), the method includes: running the compressor to compress a fluid; shutting down (422) the compressor; determining (420) a condition-dependent threshold restart pressure difference (threshold) across the compressor; relieving the pressure difference to reach the threshold; and, after the threshold is reached, restarting (434) the compressor.

19 Claims, 2 Drawing Sheets

(52) U.S. Cl.
CPC ..... *F25B 2700/1931* (2013.01); *F25B 2700/1932* (2013.01); *F25B 2700/2115* (2013.01)

(56) References Cited

U.S. PATENT DOCUMENTS

| | | | | |
|---|---|---|---|---|
| 3,633,375 | A * | 1/1972 | McLean | F25D 21/002 62/180 |
| 3,698,839 | A | 10/1972 | Distefano | |
| 4,212,168 | A * | 7/1980 | Bouchard | F01K 23/04 60/655 |
| 4,381,650 | A | 5/1983 | Mount | |
| 4,646,533 | A * | 3/1987 | Morita | F25B 41/20 62/225 |
| 6,202,431 | B1 | 3/2001 | Beaverson et al. | |
| 6,434,956 | B1 | 8/2002 | Ota et al. | |
| 6,453,691 | B1 | 9/2002 | Seo et al. | |
| 6,527,519 | B2 | 3/2003 | Hwang et al. | |
| 6,684,651 | B1 | 2/2004 | Yoshizawa et al. | |
| 6,823,686 | B2 | 11/2004 | Chumley et al. | |
| 6,962,058 | B2 | 11/2005 | Kim et al. | |
| 6,966,192 | B2 | 11/2005 | Lifson et al. | |
| 6,976,500 | B2 | 12/2005 | Lorenz-Börnert | |
| 7,197,890 | B2 | 4/2007 | Taras et al. | |
| 7,665,318 | B2 | 2/2010 | Jung et al. | |
| 7,992,399 | B2 | 8/2011 | Monk et al. | |
| 9,477,235 | B2 | 10/2016 | Noll et al. | |
| 9,488,399 | B2 | 11/2016 | Kanazawa et al. | |
| 9,766,009 | B2 | 9/2017 | Peyaud et al. | |
| 2005/0028552 | A1 | 2/2005 | Nishijima et al. | |
| 2006/0193732 | A1 | 8/2006 | Cho et al. | |
| 2009/0084119 | A1 * | 4/2009 | Lifson | F25B 49/005 62/126 |
| 2010/0161134 | A1 | 6/2010 | Takahashi | |
| 2011/0061408 | A1 * | 3/2011 | Schnelle | F24F 11/83 62/93 |
| 2012/0125025 | A1 | 5/2012 | Ishizeki et al. | |
| 2015/0159927 | A1 * | 6/2015 | Hancock | F25B 13/00 62/56 |
| 2015/0330685 | A1 * | 11/2015 | Goel | F25B 41/40 137/14 |
| 2017/0074557 | A1 | 3/2017 | Lilie et al. | |
| 2017/0159983 | A1 | 6/2017 | Furberg et al. | |
| 2017/0248353 | A1 | 8/2017 | Lee et al. | |

FOREIGN PATENT DOCUMENTS

| | | | |
|---|---|---|---|
| CN | 106969524 | A | 7/2017 |
| EP | 2476973 | A1 | 7/2012 |
| EP | 1486742 | B1 | 7/2014 |
| EP | 2321595 | B1 | 10/2017 |

* cited by examiner

METHOD FOR OPTIMIZING PRESSURE EQUALIZATION IN REFRIGERATION EQUIPMENT

CROSS-REFERENCE TO RELATED APPLICATION

Benefit is claimed of U.S. Patent Application No. 62/653,044, filed Apr. 5, 2018, and entitled "Method for Optimizing Pressure Equalization in Refrigeration Equipment", the disclosure of which is incorporated by reference herein in its entirety as if set forth at length.

BACKGROUND

The disclosure relates to compressors. More particularly, the disclosure relates to vapor compression systems (refrigeration systems) with startup pressure relief.

The pressure difference (differential) between the suction and discharge ports of a compressor may persist after the compressor shuts down. This pressure differential represents a static load on the compressor and may limit its ability to restart if operation is required while the pressure differential persists.

One solution is to simply impose a time delay on startup sufficient to allow pressures to equalize via natural leakage. To expedite, a pressure equalization valve may be used to temporarily connect the suction and discharge ports of a compressor and equalize the pressure so that the compressor may restart more quickly if needed.

SUMMARY

One aspect of the disclosure involves a method for operating a compressor having an inlet and an outlet. The method comprises: running the compressor to compress a fluid; shutting down the compressor; determining a condition-dependent threshold restart pressure difference (threshold) across the compressor; relieving the pressure difference to reach the threshold; and, after the threshold is reached, restarting the compressor.

In one or more embodiments of any of the foregoing embodiments, the condition of the determining the condition-dependent threshold restart pressure difference across the compressor comprises one or more of: time since said shutdown of the compressor; operating pressure difference across the compressor immediately prior to shutdown of the compressor; average operating pressure difference across the compressor during a period of time immediately prior to said shutdown; temperature of any part of the compressor or a point on tubing connected to the compressor; and outside air temperature.

In one or more embodiments of any of the foregoing embodiments, the condition of the determining the condition-dependent threshold restart pressure difference across the compressor comprises one or more of: time since said shutdown of the compressor where a longer time results in a higher threshold; operating pressure difference across the compressor immediately prior to shutdown of the previous operation where a higher pressure difference results in a lower threshold; average operating pressure difference across the compressor during a period of time immediately prior to said shutdown where a higher average pressure difference results in a lower threshold; temperature of any part of the compressor or a point on tubing connected to the compressor where a higher temperature results in a lower threshold; and outside air temperature where a higher air temperature results in a lower threshold.

In one or more embodiments of any of the foregoing embodiments, the condition comprises a motor temperature and the determining comprises: estimating a motor temperature; and from the estimated motor temperature, determining the threshold restart pressure difference.

In one or more embodiments of any of the foregoing embodiments, the determining the condition-dependent threshold restart pressure difference across the compressor comprises, during a shutdown, compensating for motor cooling to allow an increased said threshold restart pressure difference.

In one or more embodiments of any of the foregoing embodiments, the condition of the determining the condition-dependent threshold restart pressure difference across the compressor comprises average operating pressure difference across the compressor during a period of time immediately prior to said shutdown where a higher average pressure difference results in a lower threshold.

In one or more embodiments of any of the foregoing embodiments, the compressor is in a vapor compression system. The vapor compression system comprises: said compressor having said inlet and said outlet along a refrigerant flowpath; a first heat exchanger downstream of the outlet along the refrigerant flowpath; an expansion device downstream of the first heat exchanger along the refrigerant flowpath; a second heat exchanger downstream of the expansion device along the refrigerant flowpath; and a valve having a closed condition and an open condition and positioned so as to relieve a pressure difference between the inlet and the outlet in the open condition.

In one or more embodiments of any of the foregoing embodiments, the determining is performed by a controller.

Another aspect of the disclosure involves a vapor compression system comprising a compressor having an inlet and an outlet along a refrigerant flowpath. A first heat exchanger is downstream of the outlet along the refrigerant flowpath. An expansion device is downstream of the first heat exchanger along the refrigerant flowpath. A second heat exchanger is downstream of the expansion device along the refrigerant flowpath. A valve has a closed condition and an open condition and is positioned so as to relieve a pressure difference between the inlet and the outlet in the open condition. The system has means for detecting a pressure difference between the outlet and the inlet. A controller is configured to: determine a condition-dependent threshold restart pressure difference (threshold) across the compressor; and relieve the pressure difference to reach the threshold.

In one or more embodiments of any of the foregoing embodiments, the means for detecting the pressure difference comprises: a low side pressure sensor positioned to detect a pressure proximate the inlet; and a high side pressure sensor positioned to detect a pressure proximate the outlet.

In one or more embodiments of any of the foregoing embodiments, the controller is configured to the determine the threshold based on one or more of: time since said shutdown of the compressor; operating pressure difference across the compressor immediately prior to shutdown of the compressor; average operating pressure difference across the compressor during a period of time immediately prior to said shutdown; temperature of any part of the compressor or a point on tubing connected to the compressor; and outside air temperature.

In one or more embodiments of any of the foregoing embodiments, the controller is configured to determine the threshold based on one or more of: time since said shutdown of the compressor where a longer time results in a higher threshold; operating pressure difference across the compressor immediately prior to shutdown of the previous operation where a higher pressure difference results in a lower threshold; average operating pressure difference across the compressor during a period of time immediately prior to said shutdown where a higher average pressure difference results in a lower threshold; temperature of any part of the compressor or a point on tubing connected to the compressor where a higher temperature results in a lower threshold; and outside air temperature where a higher air temperature results in a lower threshold.

In one or more embodiments of any of the foregoing embodiments, the controller is configured to determine the threshold by: estimating a motor temperature; and from the estimated motor temperature, determining the threshold restart pressure difference.

In one or more embodiments of any of the foregoing embodiments, the controller is configured to determine the threshold by, during a shutdown, compensating for motor cooling to allow an increased said threshold restart pressure difference.

In one or more embodiments of any of the foregoing embodiments, the compressor is a rotary compressor.

In one or more embodiments of any of the foregoing embodiments, the system further comprises an outdoor air temperature sensor.

In one or more embodiments of any of the foregoing embodiments, the system further comprises a compressor temperature sensor.

In one or more embodiments of any of the foregoing embodiments, a method for using the system comprises: running the compressor to compress refrigerant and drive the refrigerant along the refrigerant flowpath; shutting down the compressor; the controller determining said threshold; the controller opening the valve to relieving the pressure difference to reach the threshold; and after the threshold is reached, the controller closing the valve; and restarting the compressor.

In one or more embodiments of any of the foregoing embodiments, the restarting is performed by the controller.

In one or more embodiments of any of the foregoing embodiments, the controller opening the valve is responsive to a restart command.

The details of one or more embodiments are set forth in the accompanying drawings and the description below. Other features, objects, and advantages will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
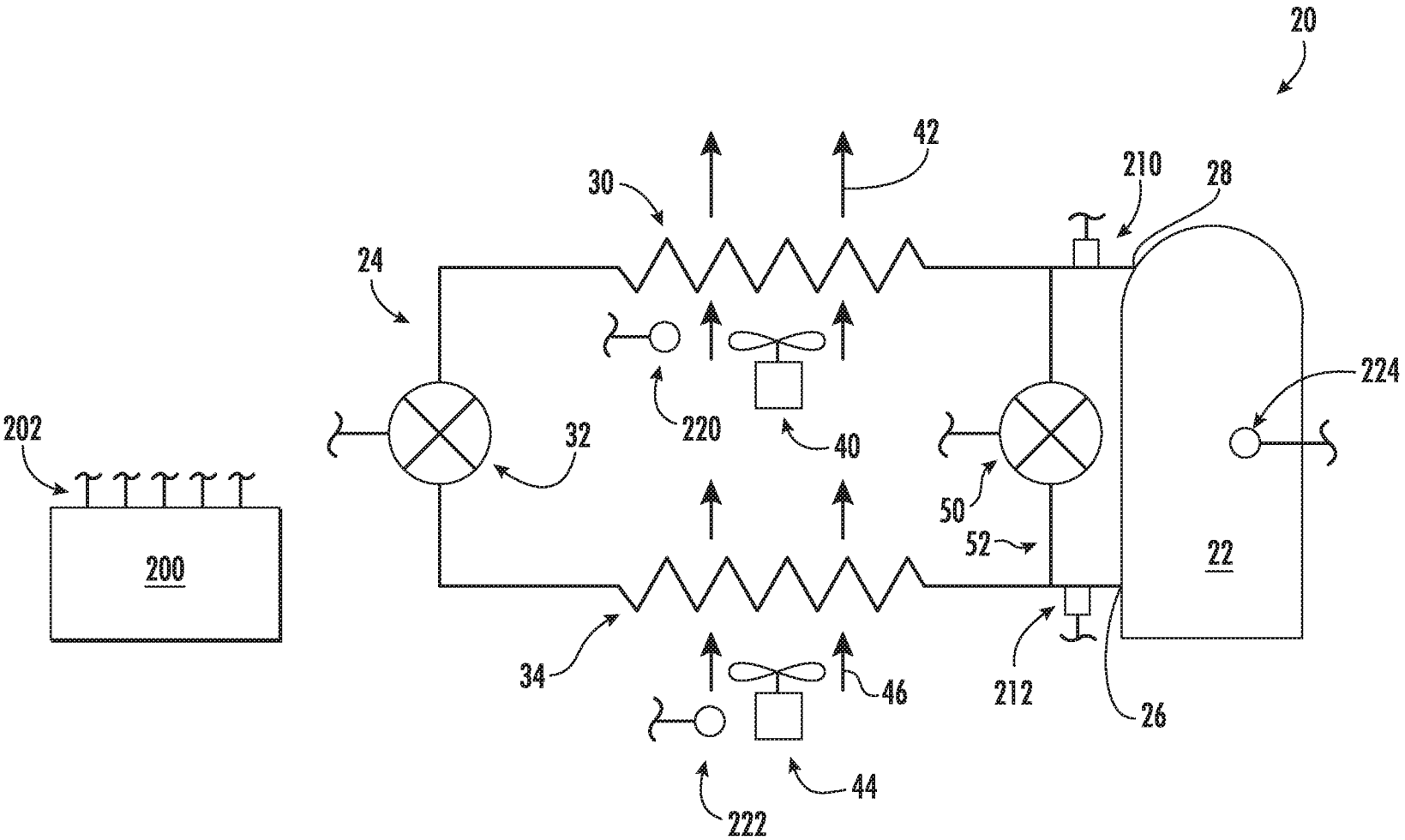
FIG. 1 is a schematic view of a vapor compression system.

The persistent pressure differential across the compressor represents stored energy. Completely eliminating this differential results in loss of all of that energy. Accordingly, it is desirable to relieve the pressure differential only sufficiently to permit acceptable restart parameters (e.g., avoiding risk of overloading the compressor). This may reduce the loss of stored energy toward the minimum required for allowing the compressor to restart. Reduced energy loss increases the efficiency of the system and may decrease the time required for the system to get up to desired operating conditions.

An optimized threshold pressure differential (threshold) may depend on system operating conditions. As is discussed below, a compressor controller may calculate the appropriate threshold and then relieve pressure down to that threshold. A key factor is motor temperature. The electric motor has a critical operating temperature limit. The pressure differential at startup relates to the torque required to start the motor. A higher pressure differential requires a higher starting torque. A higher starting torque requires higher starting current, and higher starting current produces more heat. The maximum operating temperature of the motor may be essentially a constant. A higher starting temperature means there is a smaller margin for temperature rise during start. A smaller temperature margin means that the allowable current at startup will be lower, and therefore the permissible starting torque will be lower, and therefore the allowable starting pressure differential will be lower.

Thus, at a first motor temperature at startup, there is a first pressure differential (maximum allowable startup pressure differential for that motor temperature) that requires exactly the startup current that will raise motor temperature to the allowable maximum. At a lower startup motor temperature, the corresponding maximum allowable startup pressure differential is higher and vice versa.

Thus, it may be desired to measure or indirectly calculate motor temperature at startup (or a proxy) to determine the corresponding maximum allowable startup pressure differential and relieve the pressure differential down to or below that maximum allowable startup pressure differential. In steady-state operation, one parameter correlated with motor temperature is the pressure differential. This gives rise to using pressure differential (e.g., a running average as discussed below) to calculate motor temperature and therefrom calculate the maximum allowable startup pressure differential for that motor temperature. Pressure may then be relieved down to the calculated maximum allowable startup pressure differential.

Numerous other parameters have a correlation with motor temperature and these may be used alone or in combination in the calculation. Some of these parameters are already measured in many compressors or vapor compression systems or may be calculated from existing measurements, thus imposing little or no additional cost (contrasted with adding a temperature sensor on/in the motor). One parameter is compressor temperature (e.g., elsewhere on or in the compressor than the motor) which may be measured as temperature of any part of the compressor or a point on tubing connected to the compressor (e.g., within 10 cm upstream from the suction port or 10 cm downstream from the discharge port). A higher temperature may result in a lower threshold. This is because such measured compressor temperature is indicative of compressor internal component temperature, including the temperature of the electric motor.

Another parameter is pressure difference across the compressor immediately prior to shutdown. A higher pressure difference may result in a lower threshold;

Another parameter is average operating pressure difference across the compressor during a period of time immediately prior to said shutdown. Likewise, a higher average pressure difference may result in a lower threshold. An average over an interval (e.g., 30 seconds) may be preferable to an instantaneous value because compressor motor temperature will be better represented by an average pressure differential produced over time instead of a single measurement which may be higher or lower than the average and therefore provide a less precise indicator of predicted motor temperature.

Another parameter is time since the shutdown of the compressor. A longer time may result in a higher threshold. This is because a longer time allows the compressor motor to cool to a lower temperature and provide a larger temperature margin to accommodate a higher starting current, starting torque, and therefore overcome a larger pressure differential.

Another parameter is outside air temperature. A higher air temperature may result in a lower threshold. This is because, for a given amount of time since shutdown, a higher air temperature will result in less cooling of the compressor motor.

FIG. 1 shows a vapor compression system 20 having a compressor 22 along a recirculating refrigerant flowpath 24. The exemplary system 20 is a most basic system for purposes of illustration. Many variations are known or may yet be developed. Along the flowpath 24, the compressor 22 has a suction port (inlet) 26 and a discharge port (outlet) 28. In a normal operational mode, refrigerant drawn in via the suction port 26 is compressed and discharged at high pressure from the discharge port 28 to proceed downstream along the flowpath 24 and eventually return to the suction port. Sequentially from upstream to downstream along the flowpath 24 from the discharge port 28 are: a heat exchanger 30 (in the normal mode a heat rejection heat exchanger such as a condenser); an expansion device 32 (e.g., an electronic expansion valve (EXV) or a thermal expansion valve (TXV)); and a heat exchanger 34 (in the normal mode a heat absorption heat exchanger such as an evaporator). The heat exchangers may, according to the particular task involved, be refrigerant-air heat exchangers, refrigerant-water heat exchangers, or other variants.

In an exemplary situation such as air conditioning, the heat exchanger 30 is an outdoor heat exchanger. When the heat exchanger 30 is a refrigerant-air heat exchanger, a fan 40 may drive an air flow 42 (outdoor or exterior air flow) across the heat exchanger 30. When the heat exchanger 34 is a refrigerant-air heat exchanger, a fan 44 may drive an air flow 46 (indoor or interior air flow) across the heat exchanger 34. A pressure relief valve 50 is located along a pressure relief flowpath 52 between the high side and the low side. An exemplary valve is a normally closed solenoid type valve. An exemplary relief flowpath 52 is formed by a capillary tube connecting the valve to the suction and discharge ports of the compressor. Via selection of the flow cross-section of the pressure relief flowpath, pressure relief may be kept slow enough to allow control of pressure.

FIG. 1 further shows a controller 200. The controller may receive user inputs from an input device (e.g., switches, keyboard, or the like, not shown) and sensors (e.g., pressure sensors and temperature sensors at various system locations). Exemplary pressure sensors include a high side pressure sensor 210 and a low side pressure sensor 212. The high side pressure sensor may measure pressure at discharge conditions and may be integrated with the compressor near the outlet or downstream to the heat exchanger 30. Similarly, the low side pressure sensor 212 may be integrated with the heat exchanger 34 or downstream to a location on the compressor near the inlet. The difference between pressures measured by the sensors 210 and 212 thus represents the pressure difference across the compressor between the outlet and inlet. Exemplary sensors are strain sensors (strain gauges) measuring the strain created by a pressure differential on either side of a diaphragm. One side of the differential measurement is often the surrounding ambient atmosphere providing a gage pressure measurement. Exemplary temperature sensors include an outdoor air temperature sensor 220 and an indoor air temperature sensor 222 (e.g., both thermistor-type sensors). Further temperature sensors include a compressor temperature sensor 224 (e.g., a thermistor-type sensor located somewhere on the body of the compressor). Additional sensors may include thermocouples.

The controller may be coupled to the sensors and controllable system components (e.g., valves, the bearings, the compressor motor, vane actuators, and the like) via control lines 202 (e.g., hardwired or wireless communication paths). The controller may include one or more: processors; memory (e.g., for storing program information for execution by the processor to perform the operational methods and for storing data used or generated by the program(s)); and hardware interface devices (e.g., ports) for interfacing with input/output devices and controllable system components.

The system may be made using otherwise conventional or yet-developed materials and techniques. In some implementations, the mechanical hardware may be of an existing baseline configuration and the system may differ only in controller programming.

Figure 2:
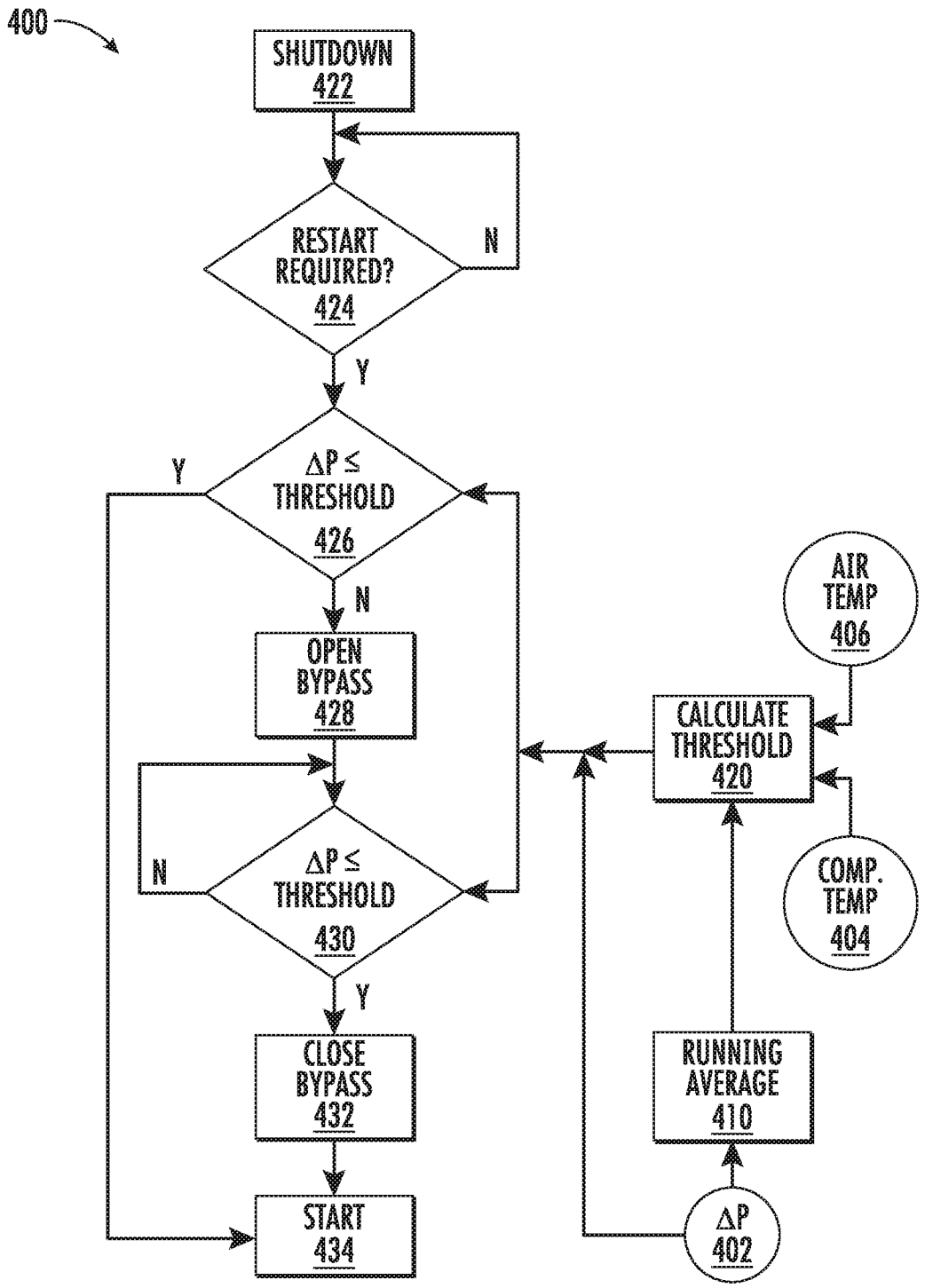
FIG. 2 is a flow chart of a shutdown and restart sequence for the vapor compression system.

FIG. 2 shows a control routine 400 which may be programmed or otherwise configured into the controller. The routine provides pressure relief at restart and may be superimposed upon the controller's normal programming/routines (not shown, e.g., providing the basic operation of a baseline system to which the foregoing control routine is added).

The controller may determine 402 the pressure differential $\Delta P$ at each cycle of its operation (e.g., clock cycle) or at a longer interval. An exemplary $\Delta P$ determination includes measuring the pressure at both the respective discharge and suction ports via the sensors 210 and 212. The compressor then subtracts the suction pressure from the discharge pressure to obtain the differential $\Delta P$. Similarly to measuring pressures via pressure gauges, the controller may measure 404 compressor temperature and/or measure 406 outdoor air temperature (e.g., a condenser inlet air temperature) via the temperature sensor(s).

As noted above, a running average calculation 410 may be applied to the $\Delta P$ to yield a $\Delta P_{AVG}$ prior to inputting to the threshold $\Delta P$ ($\Delta P_{TH}$, "threshold pressure", or just "threshold") calculation 420.

The calculation 420 may be a function, a lookup table, or the like. An example of the calculation is a two-part calculation, first calculating an estimated motor temperature and then from the estimated motor temperature calculating maximum allowable startup pressure differential or a slightly lower value for a safety margin as a threshold pressure that forms a target for relief.

At each cycle when running, the compressor may calculate 420 the threshold pressure in case of shutdown. In alternative implementations, the threshold calculation could be delayed until a shutdown is commanded 422 (e.g., either via external user input or via the controller's existing programming routines).

Upon the external or internal shutdown command 422, in some embodiments (not shown) the controller may cut power to the compressor motor and then begin any pressure relief. Or, the controller may wait until restart is required 424. Restart requirement may result from external command or internal determination by existing/baseline controller logic.

The controller may compare 426 the current or last pressure differential ΔP to the calculated threshold. If the differential exceeds the threshold, the controller opens 428 the pressure relief valve 50. The controller monitors 430 the pressure differential as it decreases and closes 432 the valve once the differential is reduced to or below the threshold and then starts 434 the motor.

Further issues attend cooling down of the motor during the time after shutdown and before restart. Compressor temperature will exponentially approach ambient. Thus, as the compressor cools, the threshold calculated immediately prior to shutdown will become progressively unnecessarily low.

In an example of compensating for this post-shutdown cooling, at shutdown, the last running average $\Delta P_{AVG}$ is stored by the controller rather continuing to average. But the calculation 420 is modified to reflect motor cooling. An example of this modification may be achieved by downwardly adjusting the stored running average $\Delta P_{AVG}$ before inputting it into the threshold calculation function, etc. The downward adjustment may reflect time and the ambient temperature. For example, at each cycle after shutdown, the controller may decrement $\Delta P_{AVG}$ from the prior cycle by a calculated amount. In one example, at each such cycle, the ambient temperature is measured. The amount of cooling during the cycle will be approximately proportional to the difference between ambient temperature and motor temperature.

With the exemplary two-part calculation 420, the adjustment may occur between the two parts. For example, the $\Delta P_{AVG}$ from the prior cycle may be put through the function or lookup table to estimate motor temperature. Then, the measured ambient temperature may be subtracted from the estimated motor temperature to produce an estimated temperature difference ΔT. ΔT may be used to calculate the estimated cooling of the motor over the one cycle. For a linear calculation this means the controller can decrement the estimated motor temperature by kΔT (where k is an experimentally derived constant) prior to inputting that into the second part of the calculation 420 that determines the threshold pressure.

An alternative genericized calculation may be in the form:

$$P_{TH}=k_1(T_{MAX}-T_{ACT})+k_2(T_{MAX}-T_{SD})k_3(1-\exp(-k_4t_{OFF}))(T_{SD}-T_{AMB})k_5(T_{MAX}-T_{AMB})$$

where $T_{MAX}$ is maximum allowable motor temperature; $T_{ACT}$ is present motor temperature (based on direct measurement or a proxy); $T_{SD}$ is motor temperature at shutdown (based on direct measurement or a proxy such as the aforementioned $\Delta P_{AVG}$); $T_{AMB}$ is present ambient temperature (e.g., measured by outdoor air temperature sensor 220); and $t_{OFF}$ is the time since shutdown. The calculation may use any combination of such terms. Further variations may conditionally use the different terms. Effectively, the respective constants could vary based on time or some other parameter. One example is that $k_5$ may be set at zero for 15 minutes after shutdown while one or more of $k_1$, $k_2$ and $k_3$ are set to non-zero values; and after said 15 minutes, $k_5$ may be set to a non-zero value while said one or more of $k_1$, $k_2$ and $k_3$ are set to zero.

If on shutdown, the differential is already less than the threshold, then actuation of the equalization valve can be avoided saving valve wear relative to systems that always open a relief valve. This capability may improve the applicability of compressor technologies that typically require pressure equalization (e.g. rotary compressors), and may make some modes of operation more desirable due to the reduced stored energy loss.

For example, during a defrost transition, it may be advantageous to shut down the compressor briefly to reduce the flow of liquid refrigerant toward the compressor. A compressor requiring equalization before startup would normally have to stay in the off state until the pressure equalizes. This represents the loss of stored energy as well as lost operating time while the equalization process occurs. These disadvantages may result in making the shutdown during defrost transition a net disadvantage. Using partial equalization to a higher threshold reduces both the lost energy and time before startup thus increasing system efficiency and allowing shutdown during transition to become advantageous.

Although some variations are noted above, many more complex variations are possible including ejector systems, systems having multiple of one or more of the identified components, systems with economizers, systems with reversing valves for heat pump or defrost operation, systems with compressor lubrication circuits, systems with compressor motor or bearing cooling circuits, and the like.

The use of "first", "second", and the like in the description and following claims is for differentiation within the claim only and does not necessarily indicate relative or absolute importance or temporal order. Similarly, the identification in a claim of one element as "first" (or the like) does not preclude such "first" element from identifying an element that is referred to as "second" (or the like) in another claim or in the description.

One or more embodiments have been described. Nevertheless, it will be understood that various modifications may be made. For example, when applied to an existing basic system, details of such configuration or its associated use may influence details of particular implementations. Accordingly, other embodiments are within the scope of the following claims.

What is claimed is:

1. A method for operating a compressor (22) having an inlet (26) and an outlet (28), the method comprising:

running the compressor to compress a fluid;

shutting down the compressor;

determining a condition-dependent threshold restart pressure difference (threshold) across the compressor;

relieving a pressure difference across the compressor to reach the threshold; and after the threshold is reached, restarting the compressor, wherein said condition comprises:

average operating pressure difference across the compressor during a period of time immediately prior to said shutdown where a higher average pressure difference results in a lower threshold.

2. The method of claim 1 wherein said condition further comprises one or more of:

time since said shutdown of the compressor;

operating pressure difference across the compressor immediately prior to shutdown of the compressor;

temperature of any part of the compressor or a point on tubing connected to the compressor; and outside air temperature.

3. The method of claim 1 wherein said condition further comprises one or more of:

time since said shutdown of the compressor where a longer time results in a higher threshold;

operating pressure difference across the compressor immediately prior to shutdown of the previous operation where a higher pressure difference results in a lower threshold;

temperature of any part of the compressor or a point on tubing connected to the compressor where a higher temperature results in a lower threshold; and outside air temperature where a higher air temperature results in a lower threshold.

4. The method of claim 1 wherein the determining the condition-dependent threshold restart pressure difference across the compressor comprises:

estimating the motor temperature; and from the estimated motor temperature, determining the threshold restart pressure difference.

5. The method of claim 1 wherein the determining the condition-dependent threshold restart pressure difference across the compressor comprises:

during a shutdown, compensating for motor cooling to allow an increase in said threshold restart pressure difference.

6. The method of claim 1 wherein the compressor is in a vapor compression system (20), the vapor compression system comprising:

said compressor (22) having said inlet (26) and said outlet (28) along a refrigerant flowpath (24);

a first heat exchanger (30) downstream of the outlet along the refrigerant flowpath;

an expansion device (32) downstream of the first heat exchanger along the refrigerant flowpath;

a second heat exchanger (34) downstream of the expansion device along the refrigerant flowpath; and a valve (50) having a closed condition and an open condition and positioned so as to relieve a pressure difference between the inlet and the outlet in the open condition.

7. The method of claim 1 wherein the determining is performed by a controller (200).

8. A vapor compression system (20) comprising:

a compressor (22) having an inlet (26) and an outlet (28) along a refrigerant flowpath (24);

a first heat exchanger (30) downstream of the outlet along the refrigerant flowpath;

an expansion device (32) downstream of the first heat exchanger along the refrigerant flowpath;

a second heat exchanger (34) downstream of the expansion device along the refrigerant flowpath;

a valve (50) having a closed condition and an open condition and positioned so as to relieve a pressure difference between the inlet and the outlet in the open condition;

means (210, 212) for detecting a pressure difference between the outlet and the inlet; and a controller (200) configured to:

determine a condition-dependent threshold restart pressure difference (threshold) across the compressor; and relieve the pressure difference to reach the threshold, wherein said condition comprises:

average operating pressure difference across the compressor during a period of time immediately prior to said shutdown where a higher average pressure difference results in a lower threshold.

9. The system of claim 8 wherein the means for detecting the pressure difference comprises:

a low side pressure sensor (212) positioned to detect a pressure proximate the inlet; and a high side pressure sensor (210) positioned to detect a pressure proximate the outlet.

10. The system of claim 8 wherein the controller is further configured to determine the threshold based on one or more of:

time since said shutdown of the compressor;

operating pressure difference across the compressor immediately prior to shutdown of the compressor;

temperature of any part of the compressor or a point on tubing connected to the compressor; and outside air temperature.

11. The system of claim 8 wherein the controller is further configured to determine the threshold based on one or more of:

time since said shutdown of the compressor where a longer time results in a higher threshold;

operating pressure difference across the compressor immediately prior to shutdown of the previous operation where a higher pressure difference results in a lower threshold;

temperature of any part of the compressor or a point on tubing connected to the compressor where a higher temperature results in a lower threshold; and outside air temperature where a higher air temperature results in a lower threshold.

12. The system of claim 8 wherein the controller is further configured to determine the threshold by:

estimating a motor temperature; and from the estimated motor temperature, determining the threshold restart pressure difference.

13. The system of claim 8 wherein the controller is configured to determine the threshold by:

during a shutdown, compensating for motor cooling to allow an increase in said threshold restart pressure difference.

14. The system of claim 8 wherein:

the compressor is a rotary compressor.

15. The system of claim 8 further comprising:

an outdoor air temperature sensor (220).

16. The system of claim 8 further comprising:

a compressor temperature sensor (224).

17. A method for using the system of claim 8, the method comprising:

running the compressor to compress refrigerant and drive the refrigerant along the refrigerant flowpath;

shutting down the compressor;

the controller determining said threshold;

the controller opening the valve to relieving the pressure difference to reach the threshold; and after the threshold is reached, the controller closing the valve; and restarting the compressor.

18. The method of claim 17 wherein:

the restarting is performed by the controller.

19. The method of claim 17 wherein:

the controller opening the valve is responsive to a restart command.

* * * * *